US007078683B2

(12) United States Patent
Joyce

(10) Patent No.: US 7,078,683 B2
(45) Date of Patent: Jul. 18, 2006

(54) NANOWIRE TARGET SUPPORT AND METHOD

(75) Inventor: Timothy H. Joyce, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 10/971,164

(22) Filed: Oct. 22, 2004

(65) Prior Publication Data

US 2006/0097149 A1 May 11, 2006

(51) Int. Cl.
*H01J 49/00* (2006.01)

(52) U.S. Cl. ..... 250/288; 250/423 R; 250/281

(58) Field of Classification Search ..... 250/288
See application file for complete search history.

(56) References Cited

OTHER PUBLICATIONS

Go et al., Desorption/Ionization on Silicon Nanowires, Anal. Chem. vol. 77, No. 6, arch 15, 2005.*
Kirakosian et al., Title: "Atomically Accurate Si Grating With 5.73 nm Period", Applied Physics Letters, vol. 79, (2001),No. 11, pp. 1608-1610.
Lin et al., Title: "Formation Of Regular Step Arrays On Si (111) 7×7", Journal Of Applied Physics, vol. 84, (1998),No. 1, pp. 255-260.
Viernow et al., Title: "Regular Step Arrays On Silicon", Applied Physics Letters, vol. 72 (1998),No. 8, 948-950.
Hu et al., Title: "Controlled Growth And Electrical Properties Of Heterojunctions Of Carbon Nanotubes And Silicon Nanowires", Letters To Nature, vol. 399, (1999), 48-51.
Xia et al., Title: "Chemistry And Physics Of Nanowires", Advanced Materials, vol. 15, (2003), pp. 351-352.
Tao et al., Title: "Langmuir-Blodgett Silver Nanowire Monolayers For Molecular Sensing Using Surface-Enhanced Raman Spectroscopy", Nano Letters, vol. 3, (2003), pp. 1229-1233.
Qian et al., Title: "Solution-Phase Synthesis Of Single-Crystalline Iron Phosphide Nanorods/Nanowires", J.Am. Chem.Soc., vol. 126, (2004), 1195-1198.
Abramson et al., Title: "Fabrication And Characterization Of A Nanowire/Polymer-Based Nanocomposite For A Prototype Thermoelectric Device", Journal Of Microelectromechanical Systems, vol. 13, (2004),No. 3, pp. 505-513.

(Continued)

*Primary Examiner*—Nikita Wells
*Assistant Examiner*—James J. Leybourne

(57) ABSTRACT

The invention provides an apparatus that produces analyte ions for detection by a detector. The apparatus includes a matrix based ion source having a nanowire target substrate for producing analyte ions, an ion transport system adjacent to the matrix based ion source for transporting analyte ions from the matrix based ion source; and an ion detector downstream from the ion transport system for detecting the analyte ions. The invention also provides a method for producing and detecting the analyte ions.

41 Claims, 3 Drawing Sheets

OTHER PUBLICATIONS

Goldberger et al., Title: "Single-Crystal Gallium Nitride Nanotubes", Letters To Nature, vol. 422, (2003), pp. 599-602.
Kuykendall et al., Title: "Crystallographic Alignment Of High-Density Gallium Nitride Nanowire Arrays", Nature, vol. 3, (2004), pp. 524-528.
Law et al., Title: "Semiconductor Nanowires And Nanotubes", Annu. Rev. Mater. Rev., (2004), pp. 83-122
Stach et al., Title: "Watching GaN Nanowires Grow", Nano Letters, vol. 3, (2003), pp. 867-869.
Zheng et al., Title: "Synthesis Of Ultra-Long And Highly Oriented Silicon Oxide Nanowires From Liquid Alloys", Advanced Materials, vol. 14, (2002), pp. 122-124.
Wu et al., Title: "Block-By-Block Growth Of Single-Crystalline Si/SiGe Superlattice Nanowires", Nano Letters, vol. 2, (2002), pp. 83-86.
Hee et al., "MM03Se3 (M=Li+,Na+,Rb+,Cs+,NMe4+) Nanowire Formation Via Cation Exchange In Organic Solution", J. Am. Chem. Soc., Vol. 123, (2001), pp. 9714-9715.
Kwan et al., Title: "Synthesis And Assembly Of BaWO4 Nanorods", Chem Commun., (2001), pp. 447-448.
Wu et al., Title: "Direct Observation Of Vapor-Liquid-Solid Nanowire Growth", J. Am. Chem. Soc., vol. 123, (2001), pp. 3165-3166.
Huang et al., Title: "Catalytic Growth Of Zinc Oxide Nanowires By Vapor Transport", Advanced Materials, vol. 13,No. 2, (2001), pp. 113-116.
Wu et al., Title: "Germanium/Carbon Core-Sheath Nanostructures", Applied Physics Letters, vol. 77, (2000), pp. 43-45.
Wu et al., Title: Germanium Nanowire Growth Via Simple Vapor Transport, Chem. Mater, vol. 12, (2000), pp. 605-607.
Gates et al., Title: "Synthesis And Characterization Of Crystalline Ag2Se Nanowires Through A Template-Engaged Reaction At Room Temperature", Advance Functional Materials, vol. 10, (2002), pp. 679-686.
Yang et al. Title: "Inorganic Semiconductor Nanowires", International Journal Of Nanoscience, vol. 1, (2002), pp. 1-39.
Robinson et al., Title: Structure Of Quantum Wires In Au/Si (557), Physical Review Letters, vol. 88, (2002), pp. 096104-1-096104-4.
Losio et al., Title: "Band Splitting For Si (557)-Au: Is It Spin-Charge Separation?", Physical Review Letters, vol. 86, (2001), pp. 4632-4635.
Viernow et al., Title: "Linear Arrays Of CaF2 Nanostructures On Si", Applied Physics Letters, vol. 74, (1999), pp. 2125-2127.

* cited by examiner

NANOWIRE TARGET SUPPORT AND METHOD

TECHNICAL FIELD

The invention relates generally to the field of mass spectrometry and more particularly toward supports for improved ionization and production of analyte ions. In particular, the invention relates to ionization techniques such as atmospheric pressure matrix assisted laser desorption (AP-MALDI), matrix assisted laser desorption (MALDI), time of flight instruments and other mass spectrometry systems.

BACKGROUND

Most complex biological and chemical targets require the application of complementary multidimensional analysis tools and methods to compensate for target and matrix interferences. Correct analysis and separation is important to obtain reliable quantitative and qualitative information about a target. In this regards, mass spectrometers have been used extensively as detectors for various separation methods. However, until recently most spectral methods provided fragmentation patterns that were too complicated for quick and efficient analysis. The introduction of atmospheric pressure ionization (API) and matrix assisted laser desorption ionization (MALDI) have improved results substantially. These methods significantly reduce fragmentation patterns and provide high sensitivity for determining the identity of a variety of compounds. Matrix based ionization techniques have been particularly effective regarding peptides, proteins, carbohydrates, oligosaccharides, natural products, cationic drugs, cyclic glucans, taxol, taxol derivatives, metalloproteins, porphyrins, kerogens, polymers and other biological and non-biological compounds.

Accordingly, in the MALDI or AP-MALDI ionization method, the analyte and matrix in solution is applied to a probe or target substrate. As the solvent evaporates, the analyte and matrix co-precipitate out of solution to form a crystal of the analyte in the matrix on the target substrate. The co-precipitate is then irradiated with a short laser pulse inducing the accumulation of a large amount of energy in the co-precipitate through electronic excitation or molecular vibration of matrix molecules. The matrix dissipates the energy by desorption, carrying the analyte into the gaseous phase. During this desorption process, ions are formed by charge transfer between the photo-excited matrix and analyte although the mechanism of the process is not well known.

MALDI ionization is typically performed using a time-of-flight analyzer. Other mass analyzers such as an ion trap (ion trap is a way of capturing ions and thus is not a detector), an ion cyclotron resonance mass spectrometer and quadrupole time-of-flight are also used. These spectrometers have a number of problems because they are required to operate under high vacuum. For instance, they limit target throughput, reduce resolution, capture efficiency and make testing targets more difficult and expensive to perform.

To overcome the disadvantages described above, another technique call AP-MALDI has been developed. This technique performs similar ionizations, but at atmospheric pressure. The MALDI and AP-MALDI ionization techniques have much in common. These techniques are based on the process of a pulsed laser beam desorption/ionization of a solid-state target material resulting in production of gas phase analtye molecular ions. The ion plume is produced as a result of ionization from a solid support or plate.

A number of techniques and components have been designed to try to improve the sensitivity of these instruments. For instance, heat or heated gas flow has been introduced into the chamber or ionization region to improve the ionization process. In addition, different type plates have been developed to improve ionization. For instance, various materials have been employed to increase photon energy transfer. These limitations and others have been obviated by the present invention.

SUMMARY OF THE INVENTION

The invention provides a mass spectrometer system comprising an ion source for producing ions, a nanowire surface for holding a sample, a laser for ionizing the sample on the nanowire surface, and a detector downstream from the ion source for detecting ions of the sample. The invention also provides an ion source for use in ionizing a sample, comprising a laser; and a surface for holding the sample, the surface comprising a nanowire material.

The invention provides a method for producing analyte ions for detection by a mass spectrometer. The method comprises concentrating analyte on a target substrate surface comprising a nanowire material, desorbing and ionizing the analyte to form analyte ions, and detecting the analyte ions with a detector.

BRIEF DESCRIPTION OF THE FIGURES

The invention is described below with reference to the following figures.

DETAILED DESCRIPTION OF THE INVENTION

Figure 1:
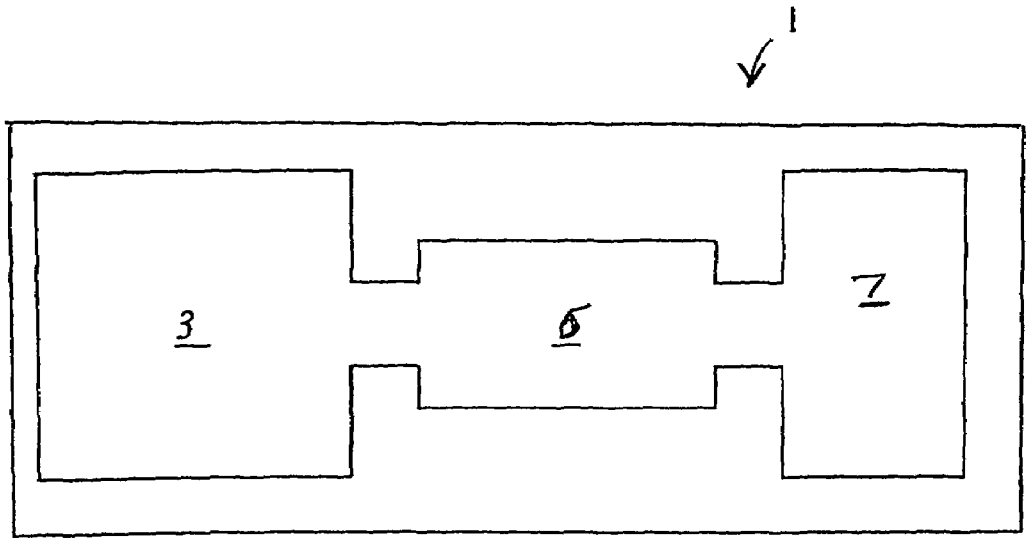
FIG. 1 shows a general block diagram of a mass spectrometer.

Before describing the invention in detail, it must be noted that as used in this specification and the appended claims, the singular forms, "a", "an", and "the" include plural referents unless the context clearly dictates otherwise. Thus, for example, reference, to "a MALDI plate" include more than one "MALDI plate". Reference to a "matrix" includes more than one "matrix" or a mixture of "matrixes". In describing and claiming the present invention, the following terminology will be used in accordance with the definitions set out below.

The term "adjacent" means, near, next to or adjoining. Something adjacent may also be in contact with another component, surround the other component, be spaced from the other component or contain a portion of the other component. For instance, a nanowire that is adjacent to a surface or plate, may be next to the surface or plate, on the surface or plate, embedded in the surface or plate, fixed to the surface or plate, contact the surface or plate, surround the surface or plate, comprise a portion of the surface or plate.

The term "enhance" refers to any physical stimulus such as heat, energy, light, or temperature change, etc. that makes a substance more easily characterized or identified. For example, a nanowire may be applied to a surface or a plate to "enhance" the production of ions. The ions increase their kinetic energy, potentials or motions and are de-clustered or vaporized. Ions in this state are more easily detected by a mass analyzer. It should be noted that when the ions are "enhanced", the number of ions detected is enhanced since a higher number of analyte ions are sampled.

The term "ion source" or "source" refers to any source that produces analyte ions. Ion sources may comprise other sources besides AP-MALDI ion sources such as electron impact (herein referred to as EI), chemical ionization (CI) and other ion sources known in the art.

The term "matrix based" or "matrix based ion source" refers to an ion source or mass spectrometer that does not require the use of a drying gas, curtain gas, or desolvation step. For instance, some systems require the use of such gases to remove solvent or cosolvent that is mixed with the analyte. These systems often use volatile liquids to help form smaller droplets. The above term applies to both nonvolatile liquids and solid materials in which the sample is dissolved. The term includes the use of a cosolvent. Cosolvents may be volatile or non-volatile, but must render the final matrix material capable of evaporating in vacuum. Such materials would include, and not be limited to m-nitrobenzyl alcohol (NBA), glycerol, triethanolamine (TEA), 2,4-dipentylphenol, 1,5-dithiothrietol/dierythritol (magic bullet), 2-nitrophenyl octyl ether (NPOE), thioglycerol, niconinic acid, cinnamic acid, 2,5-dihydroxy benzoic acid (DHB), 3,5-dimethoxy-4-hydroxycinnamic acid (sinpinic acid), a-cyano-4-hydroxycinnnnamic acid (CCA), 3-methoxy-4-dydroxycinnamic acid (ferulic acid), monothioglycerol, carbowax, 2-(4-hydroxyphenylazo)benzoic acid (HABA), 3,4-dihydroxycinnamic acid (caffeic acid), 2-amino-4-methyl-5-nitropyridine and their cosolvents and derivatives. In particular, the term refers to MALDI, AP-MALDI, fast atom/ion bombardment (FAB) and other similar systems that do not require a volatile solvent and may be operated above, at and below atmospheric pressure.

The term "detector" refers to any device, apparatus, machine, component, or system that can detect an ion. Detectors may or may not include hardware or software. In a mass spectrometer the common detector includes and/or is coupled to a mass analyzer.

The term "nanowire" refers to a non-carbon or carbon based structure that has distinct properties that are different from carbon nanotube materials. In particular, carbon nanotube materials comprise only carbon and have a hollow interior. The present term comprises doped carbon nanotubes as well as non-carbon materials. Some of the non-carbon materials may comprise silicon or silicon germanium. Other conductive or semiconductor materials known in the art may also be employed. In certain instances these materials may be electrically conductive or super conductive.

The term "structured" refers to the positioning of nanowire components in any defined or orderly arrangement that is not random. For instance, the nanowires may be stacked in a defined fashion, layered, or positioned so as to define a particular structure. In addition, they may be grown or created to form various arrays, or ordered structures that are parallel, perpendicular or other arrangements that stack in one, two or three dimensions.

The term "surface modified" refers to modifying any surface with a nanowire material. This requires more than simple application or layering on the surface. For instance, surface modification may comprise attachment to the surface by van deer waals forces, ionic bonds, covalent bonds, hydrogen bonding, or any other chemical bonding or methods. The modifications may or may not be permanent and in some cases may be reversible.

The invention is described with reference to the figures. The figures are not to scale, and in particular, certain dimensions may be exaggerated for clarity of presentation.

FIG. 1 shows a general block diagram of a mass spectrometry system. The block diagram is not to scale and is drawn in a general format because the present invention may be employed with a variety of different type of mass spectrometers. The mass spectrometry system 1 of the present invention comprises an ion source 3, an ion transport system 5, and an ion detector 7. The ion detector 7 is positioned downstream from the ion transport system 5.

The ion source 3 provided by the present invention may comprise a variety of different ion sources known in the art. For instance, a typical ion source 3 may comprise a matrix assisted laser desorption ionization source (MALDI), or atmospheric pressure matrix assisted laser desorption ionization source (AP-MALDI). In particular the invention is useful with an ion source that provides a laser or light source. Other potential sources may comprise electron ionization (EI), chemical ionization (CI), atmospheric pressure photo ionization (APPI), atmospheric pressure chemical ionization (APCI) and combinations of these devices. The invention may comprise or utilize any ion sources known or not known yet in the art which comprise a laser or the production of an ion plume, or perform a particular surface ionization or production of ion plume from a surface. The invention has potential application with multimode ionization sources that may use various combinations of ion sources. The ion source 3 may be positioned in a variety of positions and locations within the mass spectrometry system 1.

Figure 2:
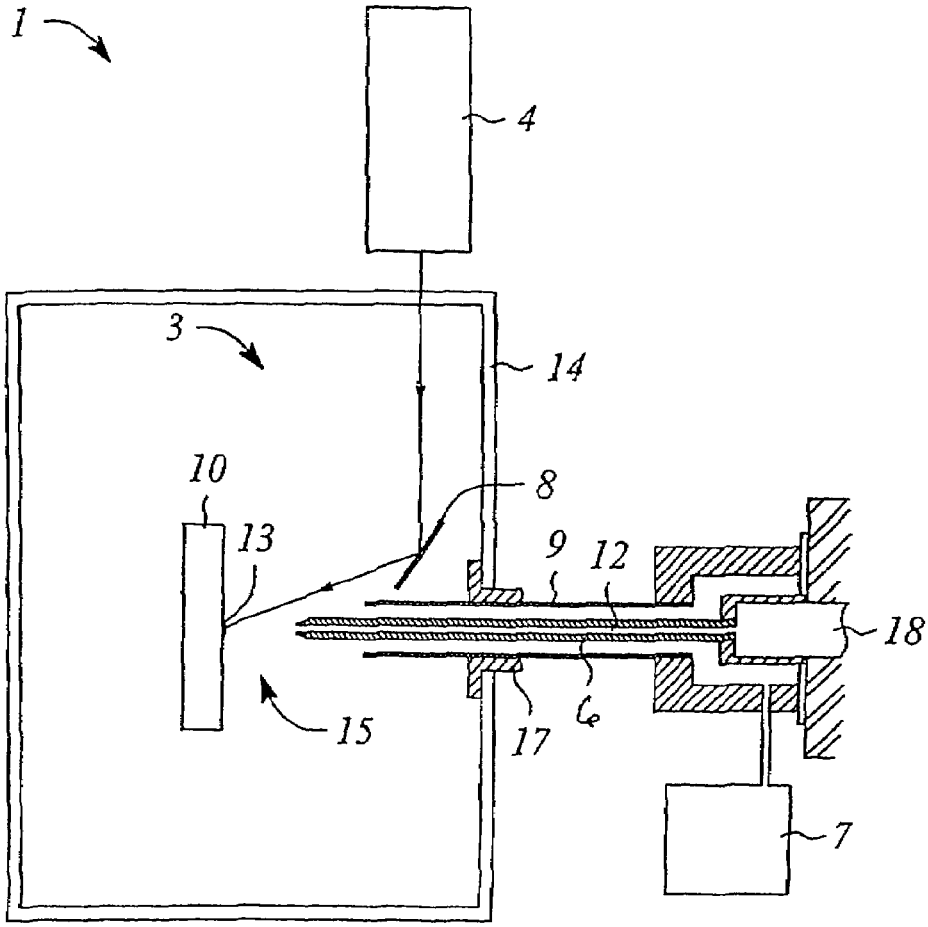
FIG. 2 shows a first embodiment of the present invention.

The ion transport system 5 is adjacent to the ion source 3 and may comprise a variety of devices known in the art (See FIG. 2). For instance, the ion transport system 5 may comprise a collecting capillary 6 or any ion optics, conduits or devices that may transport ions and that are well known in the art. Other devices that move ions from one position to another may be employed. These devices may or may not be under vacuum.

The ion detector 7 may comprise a variety of different types of detectors known in the art. The detector 7 may comprise a portion of the transport system 5 or may comprise an independent device. The ion detector 7 is design to detect the presence, quantity and type of ions produced by the mass spectrometry system 1.

FIG. 2 shows a cross-sectional view of a first embodiment of the invention. The figure shows the present invention applied to an AP-MALDI mass spectrometry system. For simplicity the figure shows the invention combined with a source housing 14. The use of the source housing 14 to enclose the ion source 3 and system is optional. Certain parts, components and systems may or may not be under vacuum. These techniques and structures are well known in the art.

The typical ion source 3 may comprise a laser 4, and a target support 10. A target 13 is applied to the target support 10. The target 13 may or may not be in a matrix material. The laser 4 provides a laser beam toward the target 13. The laser beam is directed from the laser 4 toward the target support 10 and target 13. An optional reflector 8 may be employed. The target 13 is then ionized and the analyte ions are released as an ion plume into the ionization region 15.

The ionization region 15 is located between the ion source 3 and the collecting capillary 6. The ionization region 15 comprises the space and area located in the area between the ion source 3 and the collecting capillary 6. Collecting capillary 6 may be enclosed by an optional gas conduit 9. An inert gas may be supplied to the ionization region 15 by gas conduit 9. The gas may be supplied by gas source 7. The ionization region 15 contains the ions produced by ionizing the sample that are vaporized into the gas phase. This region can be adjusted in size and shape depending upon how the ion source 3 is arranged relative to the collecting capillary 6. Most importantly, located in this region are the analyte ions produced by ionization of the target 13.

The collecting capillary 6 is located downstream from the ion source 3 and may comprise a variety of materials and designs that are well known in the art. The collecting capillary 6 is designed to receive and collect analyte ions produced from the ion source 3 that are discharged as an ion plume into the ionization region 15. The collecting capillary 6 has an elongated bore that receives the analyte ions and transports them to another capillary, or location.

Figure 3:
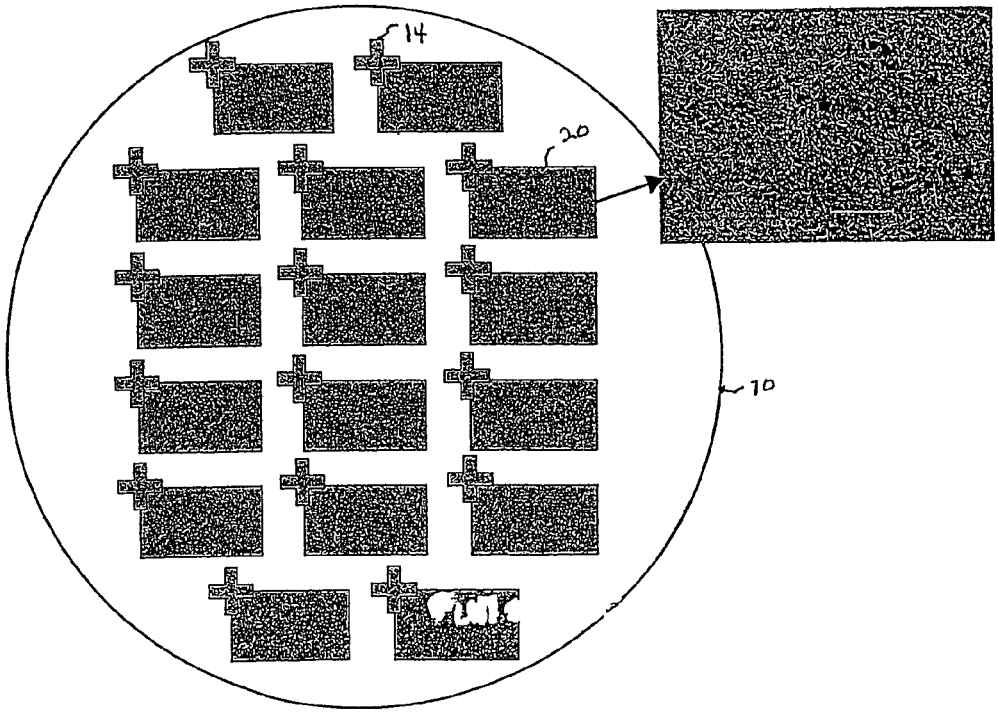
FIG. 3 shows a second embodiment of the present invention.

Important to the invention is target support 10. Target support 10 is designed to hold or maintain a target 13. The target support 10 may comprise or be coated with a nanowire material of the present invention. FIG. 3 shows an embodiment of the present invention. The present invention should not be interpreted to be limited to this embodiment of the invention. The drawing shows the target support 10 comprising a target plate. Target plates may comprise the target support 13 or a portion of it. As discussed above, target support 13 may also independently comprise a single simple surface for ionization.

Nanowires may be designed to be hydrophobic and have the capability of absorbing UV energy. These characteristics of nanowires are essential for the possible matrixless biomolecular detection. The nanowire surface is important to the invention and is attached to or comprises an ionization surface (surface modification). From a functional standpoint this may include covalent attachment or strong van der waals forces. In certain instances the nanowire material may be grown on the surface. However, this is not required. In certain instances the nanowire material may be sprayed on the surface or applied as a coating. The nanowire material creates a surface for improved ionization or production of ion plume. Nanowires provide a volatilization and subsequent ionization of analyte for improved ion plume. Since after the growth of nanowires, the surface becomes slightly roughened and provides a very large surface area as a result. This may promote the dispersion of analyte and matrix. There has been a considerable amount of investigation into the use of porous materials as MALDI plates.

Typically, nanowires can grow on a layer of transition metal catalyst pre-deposited on a substrate at optimal temperature and pressure or transition metal catalytic clusters. Nanowires can also be directly coated on a chemically modified surface. There are a number of techniques for the preparation of nanowires. A number of techniques for preparing these types of materials are also known and disclosed in the literature. For instance, semiconductor (Si, Ge, ZnO, GaN) nanowire growth has been conducted using home-build chemical vapor deposition or transport, pulsed laser ablation systems. These systems have achieved excellent control over the nanowire diameter, orientation and array density. In particular, hybrid pulsed laser deposition/chemical vapor deposition processes have been developed for synthesizing superlattice nanowires. These are examples of nanowires with vertical heterojunctions. Furthermore, a novel concept of functional composite nanotapes for synthesizing nanoribbons with multiple functionalities has been proposed and demonstrated. This process is based on epitaxial growth on nanowire substrates to form lateral heterojunctions. More recently, this process further evolved into a novel "epitaxial casting" technique, for construction of high quality, single crystalline GaN nanotubes. These nanotubes have great potential in chemical/biological sensing and nanofluidic applications. Microfluidic assisted nanowire alignment techniques have also been developed. The nanowires can be aligned and patterned on substrate using a microchannel network. This method represents the first rational chemical assembly of nanoscale junctions and devices using molecular wires as building blocks. This microfluidic assisted nanowire integration (MANI) scheme can be applied to all of the nanowire building blocks synthesized. This is a very powerful assembly technique pointing to the chemical integration of optoelectronic devices. In parallel to this microfluidic effort, we have scientists have actively developed another large area nanowire array patterning technique: Langmuir-Blodgett techniques. Nanowires with uniform sizes and aspect ratios have been used as building blocks in Langmuir-Blodgett studies. "Fabrication and Characterization of a Nanowire/Polymer-based Nanocomposite for a Prototype Thermoelectric Device", A. R. Abramson, W. C. Kim, S. T. Huxtable, H. Yan, Y. Wu, A. Majumdar, C.-L. Tien, P. Yang, J. Microelectromechanical Systems, 13, 505, 2004; "Crystallographic Alignment of High Density Gallium Nitride Nanowire Arrays", T. Kuykendall, P. J. Pauzauskie, Y. Zhang, J. Goldberger, D. Sirbuly, J. Denlinger, P. Yang, Nature Materials, 3, 528, 2004; "Semiconductor nanowires and nanotubes", M. Law, J. Goldberger, P. Yang, *Annu. Rev. Mater. Sci.* 34, 83, 2004; "Synthesis of iron phosphide nanorod/nanowires in solution", C. Qian, F. Kim, L. Ma, F. Tsui, P. Yang, J. Lie, *J. Am. Chem. Soc.* 126, 1195, 2004; "Langmuir-Blodgett silver nanowire monolayers for molecular sensing with high sensitivity and specificity", A. Tao, F. Kim, C. Hess, J. Goldberger, R. He, Y. Sun, Y. Xia, P. Yang, Nano. Lett. 3, 1229, 2003; "Watching GaN nanowires grow", E. Stach, P. Pauzauskie, T. Kuykendall, J. Goldberger, P. Yang, Nano Lett. 3, 867, 2003; "Single crystal gallium nitride nanotubes", J. Goldberger, R. He, S. Lee, Y. Zhang, H. Yan, H. Choi, P. Yang, Nature, 422, 599, 2003; "Chemistry and physics of nanowires", Y. Xia, P. Yang, Adv. Mater. 15, 351, 2003; "Synthesis and characterization of crystalline Ag2Se nanowires through a template-engaged reaction at room temperature", B. Gates, B. Mayers, Y. Wu, Y. Sun, B. Cattle, P. Yang, Y. Xia, Adv. Func. Mater. 12, 679, 2002; "Inorganic semiconductor nanowires", Y. Wu, R. Fan, P. Yang, Int. J. Nano. (Invited Review, Inaugural issue), 1, 1, 2002; Rational synthesis of ZnO nanowires and their optical properties", P. Yang, H. Yan, S. Mao, R. Russo, J. Johnson, R. Saykally, N. Morris, J. Pham, R. He, H. Choi, Adv. Func. Mater. (Invited Feature Article), 12, 323, 2002; "Synthesis of ultra-long and highly-oriented silicon oxide nanowires from alloy liquid", B. Zheng, Y. Wu, P. Yang, J. Liu, Adv. Mater. 14, 122, 2002; "Block-by-block growth of Si/SiGe superlattice nanowires", Y. Wu, R. Fan, P. Yang, Nanolett, 2, 83, 2002; "Inorganic semiconductor nanowires: rational growth, assemblies and novel properties", Y. Wu, H. Yan, M. Huang, B. Messer, J. Song, P. Yang, Chemistry, Euro. J. (Invited Concept Article) 8, 1260, 2002; "MMo3Se3 (M=Li+, Na+, Rb+, Cs+, NMe4+) nanowire formation via Chimie Douce reaction", J. Song, B. Messer, Y. Wu, H. Kind P. Yang, J. Am. Chem. Soc. 123, 9714, 2001; "Synthesis and assembly of BaWO4 nanorods", S. Kwan, F. Kim, J. Arkana, P. Yang, Chem. Commun., 5, 447, 2001; "Direct observation of vapor-liquid-solid nanowire growth", Y. Wu, P. Yang, J. Am. Chem. Soc. 123, 3165, 2001; Catalytic growth of zinc oxide nanowires through vapor transport", M. Huang, Y. Wu, H. Feick, N. Tran, E. Weber, P. Yang, Adv. Mater. 13(2), 113, 2001; "Germanium/carbon core-sheath nanostructures", Y. Wu, P. Yang, Appl. Phys. Lett. 77, 43, 2000; "Germanium nanowire growth via simple vapor transport", Y. Wu, P. Yang, Chem. Mater. 12, 605, 2000; "Growth and electrical properties of nanotube/nanowire heterojunctions", J. Hu, M. Ouyang, P. Yang, C. M. Lieber, Nature, 399, 48, 1999. These references are herein incorporated by reference in their entirety; J. Viernow et al., Appl. Phys. Lett. 72, 948 (1998); J.-L. Lin et al., J. Appl. Phys. 84, 255 (1998); A. Kirakosian et al., Appl. Phys. Lett. 79, 1608 (2001); J. Viernow et al., Appl. Phys. Lett. 74, 2125 (1999); R. Losio et al., Phys. Rev. Lett. 86, 4632 (2001).

I. K. Robinson et al., Phys. Rev. Lett. 88, 096104 (2002).

The nanowires have the added advantage of being able to easily align themselves in a defined direction. Nanowires largely comprise a filled ring structure organized in a variety of ways. For instance, they may be ordered at the atomic level as well as to form larger ordered structures and/or supramolecular structures. These various ordered structures are applicable to the present invention and improve over the prior art in providing more efficient ion plume. Other methods and techniques known and developed in the art may be employed. These references are herein incorporated by reference in their entirety.

Nanowires may be grown on a surface. In particular, the density, position and ordering of the materials may be controlled. This is important to the invention. In particular, the above technique may be applied to grow or "seed" nanowires on a MALDI or AP-MALDI plate.

EXAMPLE 1

Spray Approach

Other approaches may be employed to coat nanowires. For instance, a second approach comprises preparing the nanowires first from methods described above and spraying them on the surface. Irregular patches of nanowire blobs or bundles rather than uniformly dispersed nanowires are formed on the surface.

EXAMPLE 2

Surface Coating Approach

Another technique for preparing a nanowire surface comprises the use of a coating. The nanowires can be suspended in chloroform and then deposited. The solution may be sonicated right before the deposition to avoid/minimize the aggregation of nanowires.

Next, the solution may deposited on the desired location on a chemically modified hydrophobic glass substrate. Theoretically, hydrophobic modification aids the attachment of nanowires on the surface since nanowires are also hydrophobic. The chloroform may then be evaporated rapidly at room temperature, leaving nanowires on the surface. The process should be repeated four times to obtain the desired nanowire density.

EXAMPLE 3

A variety of nanowires can be grown directly onto a thermal oxide, silicon nitride or other surface using a catalyst such as gold, nickel or titanium. For further information regarding the preparation please see the references listed above.

EXAMPLE 4

AP-Maldi Measurements on Grown Nanowire Surface:

Nanowires substrates may be used as MALDI targets and applied to surfaces either through coating or grown by chemical vapor deposition. An Agilent AP-MALDI source and instrument (LC/MSD Ion Trap XCT) may be used for experiments. Nitrogen laser at 10 Hz with 400 micron fiber coupling may be specialized for these experiments. The operating laser power would be set at ~30 uJ/pulse. Acquisition time of about 30 second would be used. Commercial titanium nitrite target can be used as a control. Tryptic digest of apotransferrin, BSA and peroxidase can be dissolved in 0.5 mg/ml or 0.25 mg/ml of CHCA matrix. 0.5 ul of solution can be spotted on the commercial titanium nitrite and on nanowire surfaces. The quantity of tryptic digest of apotransferrin would 5 fmole. The quantity of tryptic digest of BSA and peroxidase would be 500 attomole. 0.25 mg/ml of CHCA matrix could be used for tryptic digest of BSA and peroxidase.

I claim:

1. A mass spectrometer system comprising:

(a) an ion source for producing ions;

(b) a nanowire surface disposed in the ion source for holding a sample;

(c) a laser for ionizing the sample on the nanowire surface; and (d) a detector downstream from the ion source for detecting ions of the sample.

2. A mass spectrometer system as recited in claim 1, wherein the ion source comprises an AP MALDI ion source.

3. A mass spectrometer system as recited in claim 1, wherein the ion source comprises a MALDI ion source.

4. A mass spectrometer system as recited in claim 1, wherein the nanowire surface comprises a coating or growing in the presence of a catalyst.

5. A mass spectrometer system as recited in claim 1, wherein the nanowire surface comprises a portion of a plate used for ionizing the sample.

6. A mass spectrometer system as recited in claim 1, wherein the nanowire surface is hydrophobic.

7. A mass spectrometer system as recited in claim 1, wherein the nanowire surface is structured.

8. A mass spectrometer system as recited in claim 1, wherein the nanowire surface is unstructured.

9. An ion source for use in ionizing a sample, comprising:

(a) a laser; and (b) a nanowire surface for holding the sample.

10. An ion source as recited in claim 9, wherein the nanowire surface comprises a coating.

11. An ion source as recited in claim 9, wherein the nanowire surface comprises a portion of a plate.

12. An ion source as recited in claim 9, wherein the nanowire surface is hydrophobic.

13. An ion source as recited in claim 9, wherein the nanowire surface is structured.

14. An ion source as recited in claim 9, wherein the nanowire surface is unstructured.

15. A method of making a surface for ionizing a sample in a mass spectrometer ion source, comprising coating the surface with a nanowire material.

16. A method of making a surface for ionizing a sample in a mass spectrometer ion source, comprising constructing a plate comprising a nanowire material.

17. A method of ionizing a sample in a mass spectrometer system, comprising:

(a) preparing a nanowire surface;

(b) placing a sample on the nanowire surface; and (c) ionizing the sample.

18. A method of ionizing a sample as recited in claim 17, further comprising applying a hydrophilic surface before preparing the nanowire surface.

19. A target substrate for use with a matrix based ion source, having a nanowire target substrate surface that provides ion formation.

20. A target substrate as recited in claim 19, wherein the matrix based ion source comprises a matrix assisted laser desorption ionization (MALDI) source.

21. A target substrate as recited in claim 19, wherein the ion source comprises a fast atom bombardment (FAB) ion source.

22. A target substrate as recited in claim 19, wherein the ion source comprises an atmospheric pressure matrix assisted laser desorption ionization (AP-MALDI) ion source.

23. A target substrate as recited in claim 19, wherein the ion source is at atmospheric pressure.

24. A target substrate as recited in claim 19, wherein the ion source is below atmospheric pressure.

25. A mass spectrometer system, comprising:

(a) an irradiating source for ionizing a matrix based sample;

(b) a hydrophobic target substrate adjacent to the irradiating source for supporting the matrix based sample, the hydrophobic target substrate having a nanowire target surface for concentrating the matrix based sample on the nanowire target before it is desorbed and ionized to form analyte ions;

(c) a collecting capillary downstream from the irradiating source for receiving the analyte ions produced from the matrix based sample; and (d) a detector downstream from the collecting capillary for detecting the analyte ions received from the collecting capillary.

26. A mass spectrometer system as recited in claim 25, wherein the ion source is a matrix assisted laser desorption ionization (MALDI) source.

27. A mass spectrometer system as recited in claim 25, wherein the ion source is a fast atom bombardment (FAB) ion source.

28. A mass spectrometer system as recited in claim 25, wherein the ion source is an atmospheric pressure matrix assisted laser desorption ionization (AP-MALDI) source.

29. A mass spectrometer system as recited in claim 25, wherein the ion source is at atmospheric pressure.

30. A mass spectrometer system as recited in claim 25, wherein the ion source is below atmospheric pressure.

31. A mass spectrometer system as recited in claim 25, wherein the ion source is above atmospheric pressure.

32. A mass spectrometer system as recited in claim 25, wherein the volume of the ionization region is from 1–5 $mm^3$.

33. A method for producing and detecting analyte ions in a mass spectrometer system, comprising:

(e) applying a sample to a nanowire target substrate surface;

(f) ionizing the sample to produce analyte ions; and (g) detecting the analyte ions.

34. The method of claim 33, further comprising collecting the analyte ions in a collecting capillary before the analyte ions are detected.

35. An apparatus that produces analyte ions for detection by a detector, comprising:

(a) a matrix based ion source having a nanowire target substrate for producing analyte ions;

(b) an ion transport system adjacent to the matrix based ion source for transporting analyte ions from the matrix based ion source; and (c) an ion detector downstream from the ion transport system for detecting the analyte ions.

36. An apparatus as recited in claim 35, wherein the ion detector comprises a mass analyzer.

37. An apparatus as recited in claim 35, wherein the ion transport system comprises a collecting capillary.

38. A mass spectrometer system, comprising:

(a) an ion source having a nanowire target substrate for producing analyte ions;

(b) an ion transport system adjacent to the ion source for transporting the analyte ions from the ion source; and (c) an ion detector downstream from the ion source for detecting the analyte ions.

39. A mass spectrometer as recited in claim 38, wherein the ion detector comprises a mass analyzer.

40. A mass spectrometer as recited in claim 38, wherein the ion transport system comprises a collecting capillary.

41. A mass spectrometer system, comprising:

(a) a matrix based ion source comprising:

i. an irradiating source for ionizing a matrix and sample to form analyte ions; and ii. a nanowire target substrate adjacent to the irradiating source for supporting the matrix and sample, the nanowire target substrate having a target surface for concentrating the matrix and sample on the target substrate surface;

(b) a collecting capillary downstream from the irradiating source and the target substrate for receiving the analyte ions; and (c) a detector downstream from the collecting capillary for detecting the analyte ions received by the collecting capillary.

* * * * *